US007749565B2

(12) United States Patent
Johnson et al.

(10) Patent No.: US 7,749,565 B2
(45) Date of Patent: Jul. 6, 2010

(54) METHOD FOR APPLYING AND DIMENSIONING AN ABRADABLE COATING

(75) Inventors: Curtis Alan Johnson, Niskayuna, NY (US); Yuk-Chiu Lau, Ballston Lake, NY (US); Joshua Lee Margolies, Niskayuna, NY (US); Herbert Chidsey Roberts, III, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 767 days.

(21) Appl. No.: 11/537,278

(22) Filed: Sep. 29, 2006

(65) Prior Publication Data

US 2010/0124608 A1 May 20, 2010

(51) Int. Cl.
*B05D 3/00* (2006.01)

(52) U.S. Cl. ..... 427/271; 427/448; 427/154; 427/356; 427/357

(58) Field of Classification Search ..... 427/271, 427/448, 154, 356, 357
See application file for complete search history.

(56) References Cited

U.S. PATENT DOCUMENTS

| | | | | |
|---|---|---|---|---|
| 6,503,574 | B1 * | 1/2003 | Skelly et al. | 427/446 |
| 6,887,528 | B2 | 5/2005 | Lau et al. | |
| 2004/0005452 | A1 | 1/2004 | Dorfman et al. | |
| 2005/0003172 | A1 | 1/2005 | Wheeler et al. | |
| 2006/0110247 | A1 | 5/2006 | Nelson et al. | |
| 2006/0110248 | A1 | 5/2006 | Nelson et al. | |

FOREIGN PATENT DOCUMENTS

| | | | |
|---|---|---|---|
| EP | 1548144 | A1 | 11/2004 |
| WO | 02099254 | A1 | 12/2002 |
| WO | 03026886 | A2 | 4/2003 |

OTHER PUBLICATIONS

EP Search Report for Application No. 07117320.7, dated Mar. 5, 2009.

* cited by examiner

*Primary Examiner*—Roberts Culbert
(74) *Attorney, Agent, or Firm*—Cantor Colburn LLP

(57) ABSTRACT

Disclosed is a coated substrate including a substrate coating applied to at least one substantially flat surface of the substrate, the coating including at least one of an axial concavity and a circumferential curvature, the substrate being configured for disposal parametrically about a moving component.

9 Claims, 10 Drawing Sheets

METHOD FOR APPLYING AND DIMENSIONING AN ABRADABLE COATING

FIELD OF THE INVENTION

The disclosure relates generally to a method for applying an abradable coating to a substrate, and more specifically to a method for applying and dimensioning the abradable coating.

BACKGROUND OF THE INVENTION

In a gas turbine engine, in order to achieve maximum engine efficiency (and corresponding maximum electrical power generation), it is important that the buckets rotate within the turbine casing or "shroud" with minimal interference and with the highest possible efficiency relative to the amount of energy available from the expanding working fluid. Typically, highest operation efficiencies can be achieved by maintaining a minimum threshold clearance between the shroud and tips of the bucket. Maintaining a minimum clearance prevents unwanted "leakage" of a hot gas over tip of the buckets, increased clearances lead to leakage problems and cause significant decreases in overall efficiency of the turbine. However, it should be appreciated that if bucket tips rub against a particular location of the shroud such that the bucket tip is eroded, the erosion of the bucket tip increases clearances between bucket tip and shroud in other locations, again resulting in unwanted leakage.

The need to maintain adequate clearance without significant loss of efficiency is made more difficult by the fact that as the turbine rotates, centrifugal forces acting on the turbine components can cause the buckets to expand in an outward direction toward the shroud, particularly when influenced by the high operating temperatures. Thus, it is important to establish the lowest effective running clearances between the shroud and bucket tips at the maximum anticipated operating temperatures.

Abradable type coatings have been applied to the turbine shroud to help establish a minimum, i.e., optimum, running clearance between the shroud and bucket tips under steady-state temperature conditions. In particular, coatings have been applied to the surface of the shroud facing the buckets using a material that can be readily abraded by the tips of the buckets as they turn inside the shroud at high speed with little or no damage to the bucket tips. Initially, a clearance exists between the bucket tips and the coating when the gas turbine is stopped and the components are at ambient temperature. Later, during normal operation the clearance decreases due to the centrifugal forces and temperature changes in rotating and stationary components inevitably resulting in at least some radial extension of the bucket tips, causing them to contact the coating on the shroud and wear away a part of the coating to establish the minimum running clearance. With abradable coatings clearances can be reduced with the assurance that if contact occurs, the sacrificial part is the abradable coating instead of the bucket tip.

Typically, the shrouds to which abradable coatings are applied to are fabricated (i.e. machined or cast) to include a concave profile that mates with a convex contour of a surface of the bucket tips (the rotation of the bucket tip will form a convex contour towards the shroud, though it should be appreciated that the surface of each bucket tip is not necessarily convex, and may be flat). Mating the concavely machined shroud with the convex bucket tip in this manner maintains a minimum clearance over the whole surface of the tip. Since an abradable coating applied to a concavely machined shroud includes the profile of the shroud to which it is applied, the abradable coating is also concavely disposed to mate with the convex tip. However, manufacturing a shroud to include the concave profile, or any desired profile, can be difficult and expensive. Thus, a method that would allow the abradable coating to include a profile that matches the profile of the bucket tips with which it interacts without machining the shroud is desirable.

BRIEF DESCRIPTION OF THE INVENTION

Disclosed is a coated substrate including a substrate coating applied to at least one substantially flat surface of the substrate, the coating including at least one of an axial concavity and a circumferential curvature, the substrate being configured for disposal parametrically about a moving component.

Also disclosed is a method for applying and dimensioning a substrate coating, the method including applying at least one substrate layer to at least one surface of a substrate, creating the substrate coating via the applying of the at least one substrate layer, intentionally removing a portion of coating material from the at least one substrate layer via at least one moving component operating in proximity to the substrate, and shaping the substrate coating to include a desired profile via the removing.

Further disclosed is a method for applying and dimensioning a substrate coating, the method including applying at least one substrate layer to at least one flat surface of a substrate, the substrate being configured for disposal parametrically about a moving component, creating the substrate coating via the applying of the at least one substrate layer, and shaping at least one of the at least one substrate layers to include at least one of an axial concavity and a circumferential curvature.

BRIEF DESCRIPTION OF THE DRAWINGS

Referring now to the drawings wherein like elements are numbered alike in the several FIGURES.

DETAILED DESCRIPTION

Figure 1:
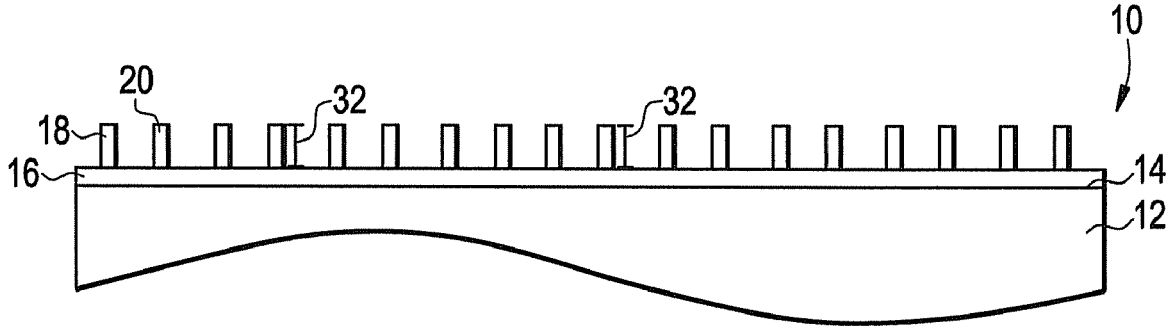
FIG. 1 is a schematic cross-section of a side view of an abradable coating applied to a substrate including a substantially flat surface.

Referring to FIG. 1, a substrate coating, such as an abradable coating 10, is shown applied to a substrate 12 including a substantially flat surface 14, wherein the coating 10 is applied in at least one substrate layer, such as abradable layers 16 and 18. In an exemplary embodiment, the substrate 12 is a turbine shroud, to which the coating 10 is applied in an adhering layer and a patterned layer. Though the substrate 12 will not be limited to a turbine shroud, and the at least one layer 16 and 18 will not be limited to an adhering layer and a patterned layer, for purposes of clarity and simplicity, the substrate 12 will be referred to as the shroud 12, and the at least one layer 16 and 18 will be referred to as the adhering layer 16 and the patterned layer 18 hereinafter.

The adhering layer 16 is applied to the substantially flat surface 14 of the shroud 12, which will typically be environmental barrier coated (EBC). The adhering layer 16 may be a metallic bond coat, such as MCrAlY, or a ceramic layer such as yttria stabilized zirconia or barium strontium aluminosilicate. The layer 16 may be applied via a powder that is cut to any desired size or coarseness, and then sprayed or flash coated, though application is not limited to these methods, onto the shroud 12 via a thermal spray process, such as air plasma spray or physical vapor deposition (PVD).

Applied to the adhering layer 16 is the patterned layer 18. The patterned layer 18 will typically be a ceramic layer, such as yttria stabilized zirconia or barium strontium aluminosilicate. The layer 18 may be applied via a powder that is cut to any desired size or coarseness, and then sprayed onto the adhering layer 16 through a patterned mask disposed on the adhering layer 16, though application is not limited to inclusion of the patterned mask. In an exemplary embodiment, the powder that will be the patterned layer 18 may be applied via a thermal spray process, such as air plasma spray, wherein the powder may be applied in multiple passes of air plasma spray. Alternatively, a PVD coating would be built up with prolonged exposure to the vapor phase of the coating material after it had similarly passed through a patterned mask. The patterned layer 18 left behind by the patterned mask defines at least one ridge 20. It should be appreciated that application of the coating 10 may also include a heat treatment of the layers 16 and 18 (though application is not limited to inclusion of this treatment), which may aid in bonding and strengthening of the layers (to help avoid coating erosion), and creating a desired coating porosity. By applying the layer 16 and 18 as discussed hereinabove, the abradable coating 10 is created on the shroud 12, and includes the shrouds essentially flat profile.

Figure 2:
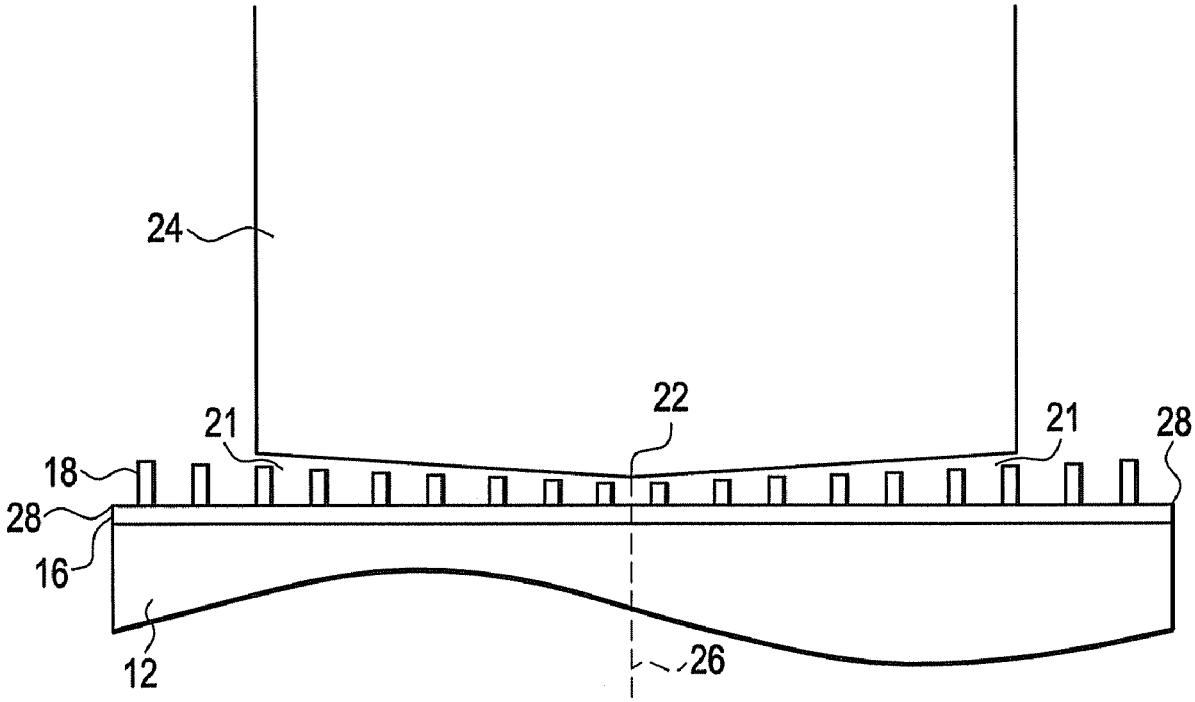
FIG. 2 is a schematic cross-section of side view of the abradable coating applied to a substrate including a substantially flat surface and a moving component operating in proximity to the substrate.

With the coating 10 having been created on the shroud 12, a portion of abradable material of at least one of the abradable layers 16 and 18 may be removed, creating an axial concavity 30 in the shroud, via a moving component 22, as shown in FIG. 2 and. In an exemplary embodiment, the moving component 22 may be a tip of a bucket that is associated with a rotor 23 (see FIGS. 5-6) and rotating during operation of a turbomachine (not illustrated in its entirety). Though the moving component 22 will not be limited to a blade tip, for purposes of clarity and simplicity the moving component 22 will be referred to as the tip 22 of the rotating bucket 24 hereinafter.

Figure 3:
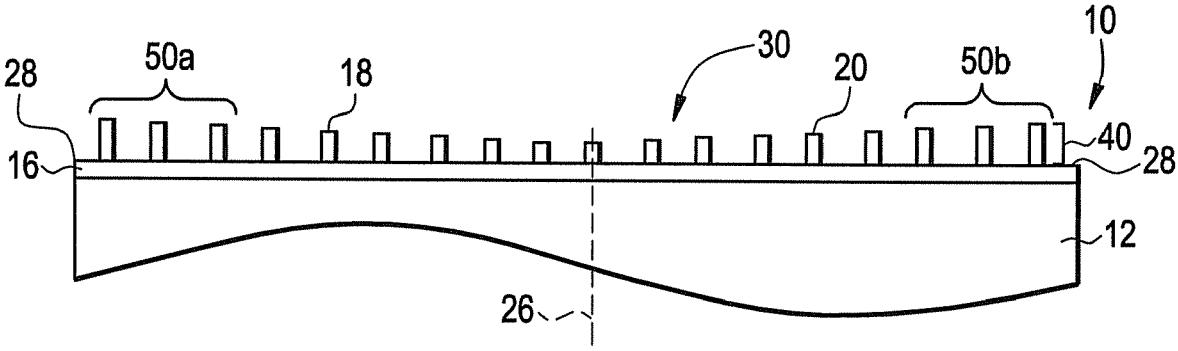
FIG. 3 is a schematic cross-section of a side view of the abradable coating applied to a substrate including a substantially flat surface, wherein the coating has been shaped.

As is known in the art, maintaining a minimum threshold clearance 21 between the shroud 12 and the tip 22 of the bucket 24 is desirable. Because of this desire to maintain threshold clearance 21 at a minimum, the tip 22 of the bucket 24 can sometimes come into contact with at least one of the layers 16 and 18 of the coating 10. Because, in an exemplary embodiment, the bucket tip 22 is convex towards the flat surface 14 (it should be appreciated that the tip 22 may also be flat), contact between the bucket tip 22 and flat coating 10 occurs most frequently at an extended relative centerline 26 of the shroud 12, where the threshold clearance 21 is at its least. As the threshold clearance 21 becomes larger away from the centerline 26 (in a direction of either side 28 of the shroud 12), contact between the bucket tip 22 and the flat coating 10 occurs less frequently. As such, less material is removed from the coating 10 in regions of the coating successively further from the centerline 26, creating a concave profile in the coating 10 in relation to the tip 22, as shown in FIGS. 2 and 3. Thus, the convex rotating tip 22 may be used to intentionally shape the desired axial concavity 30 in the coating. In addition, it should be appreciated that a rotating tip 22 (or moving component of any kind that operates in proximity the shroud or substrate) may be chosen to include a desirable shape (concave, convex, or otherwise) that will move/rotate to shape an abradable coating via a removal of abradable material caused by the moving/rotating.

Figure 4:
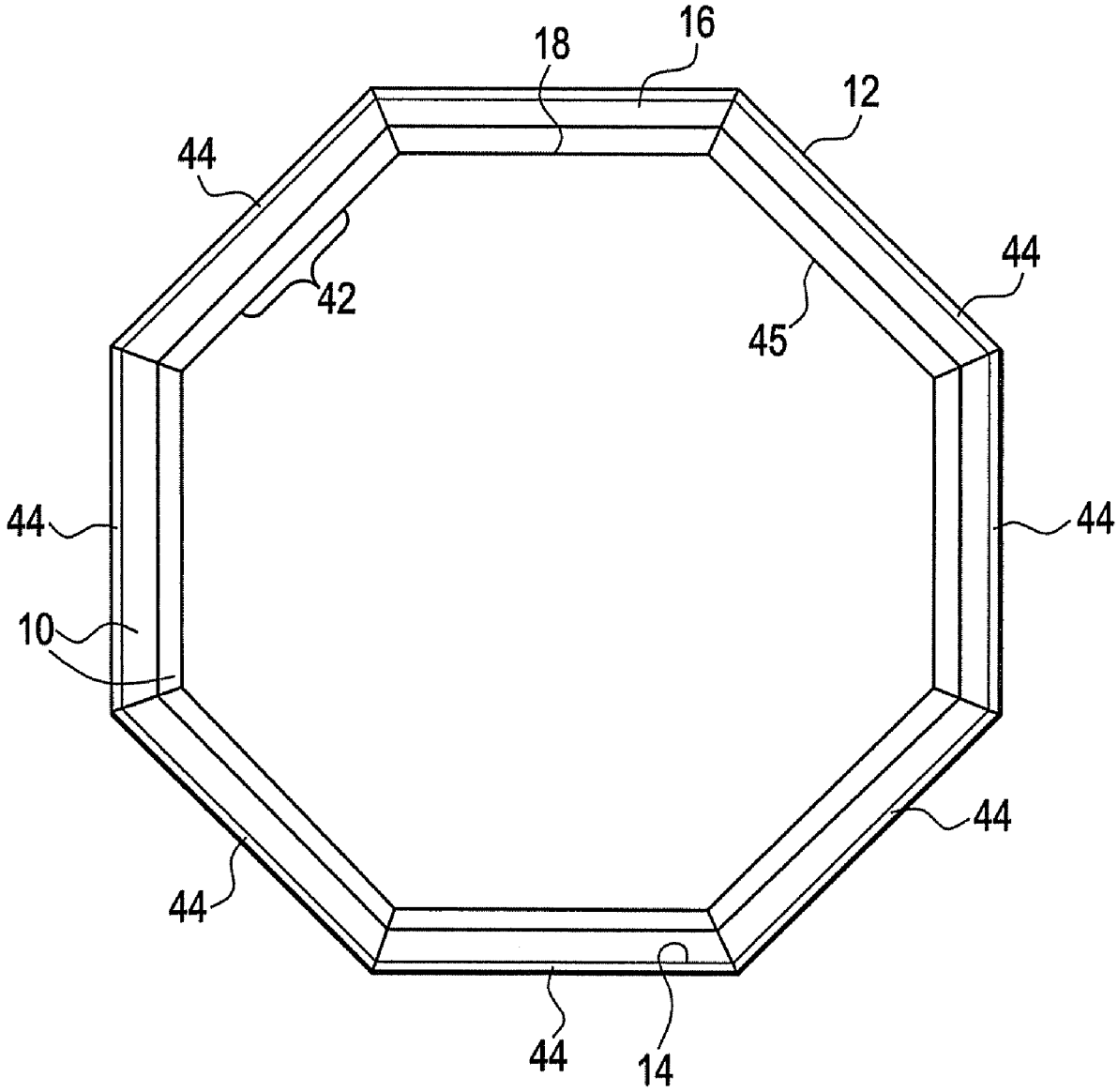
FIG. 4 is a schematic representation of a side view of the abradable coating applied to a substrate including a substantially flat surface.
Figure 5:
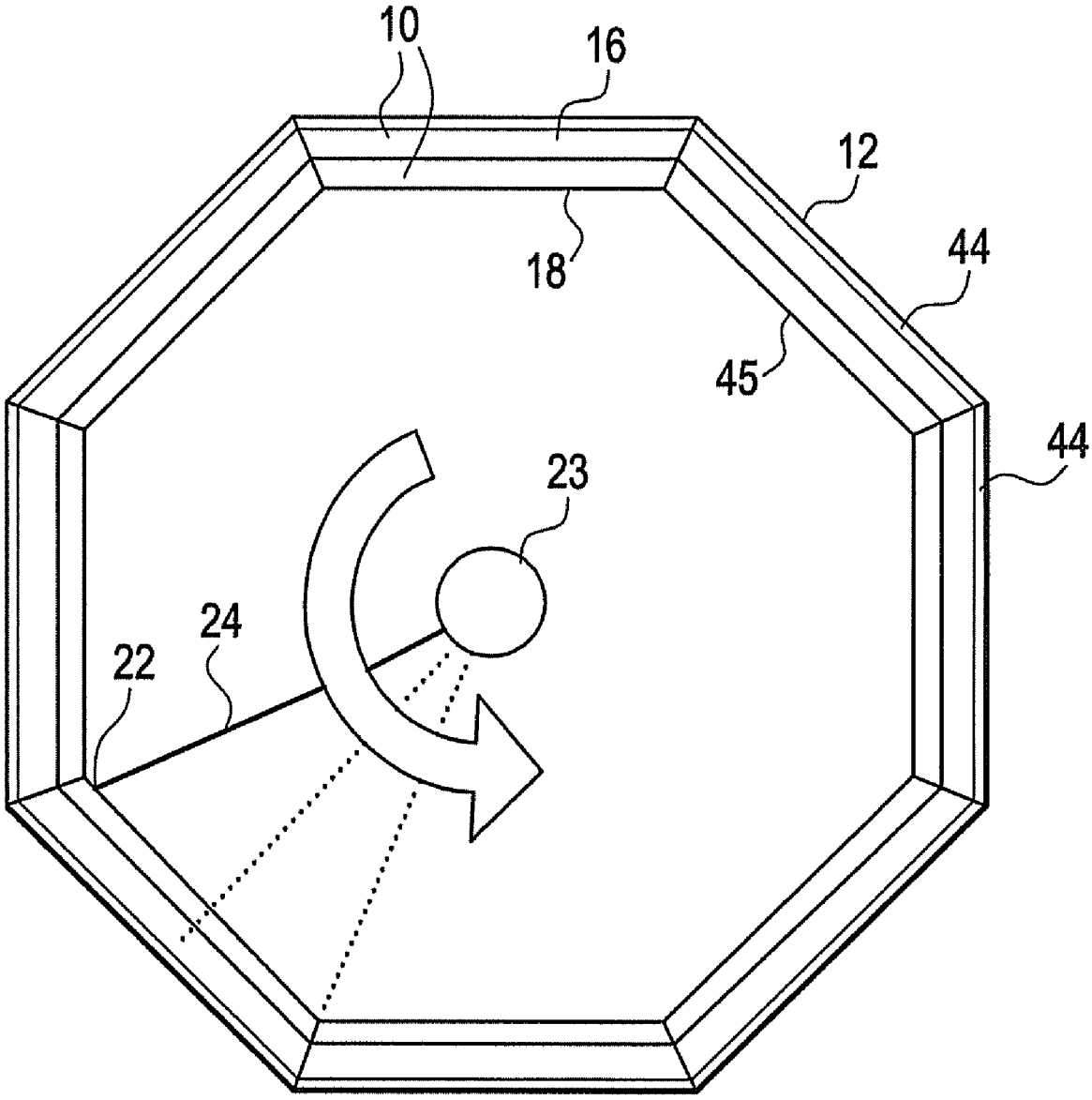
FIG. 5 is a schematic representation of a side view of the abradable coating applied to a substrate including a substantially flat surface and a moving component operating in proximity to the substrate.
Figure 6:
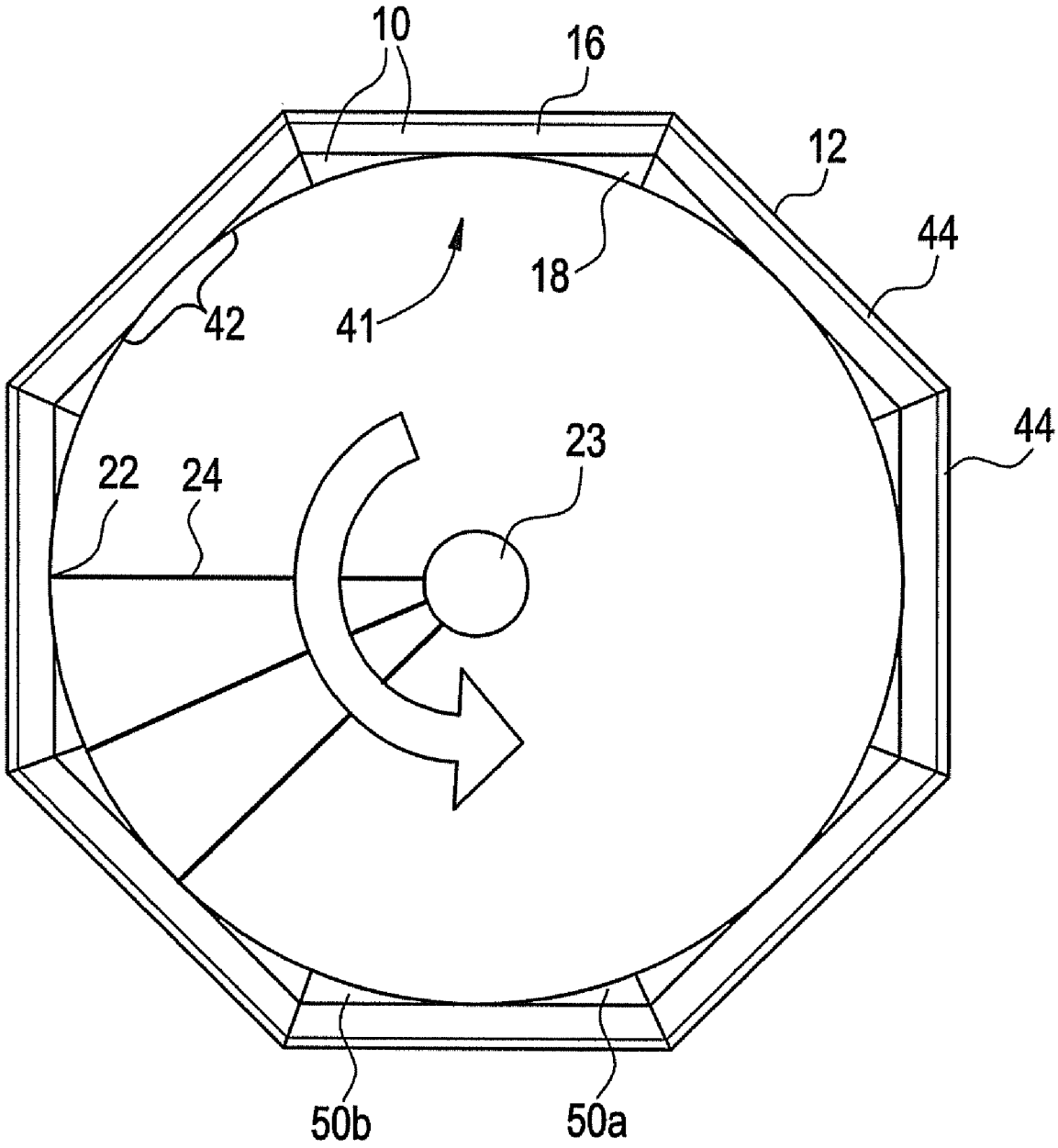
FIG. 6 is a schematic representation of a side view of the abradable coating applied to a substrate including a substantially flat surface, wherein the coating has been shaped.

Additionally, a portion of abradable material of at least one of the abradable layers 16 and 18 may be removed, via the moving component 22, to create a circumferential curvature 41 in the shroud 12, as shown in FIGS. 4-6. As in the exemplary embodiment above, the moving component 22 may be a tip of a bucket that is associated with the rotor 23 and rotating during operation of a turbomachine (not illustrated in its entirety). Again, though the moving component 22 will not be limited to a blade tip, for purposes of clarity and simplicity the moving component 22 will be referred to as the tip 22 of the rotating bucket 24 hereinafter.

Referring to FIG. 4, the shroud 12 may include a plurality of shroud segments 44 (the shroud 12 may include any number of segments 44, with an exemplary embodiment including 96 or 120). Each segment 44 is shown with the coating 10 having been applied to its substantially flat surface 14, wherein the originally applied coating 10 also includes a substantially flat coating surface 45. As mentioned above, the tips 22 of the bucket 24 can sometimes come into contact with the coating 10, as shown in FIG. 5. As the bucket tips 22 rotate during operation of the machine, contact between the bucket tips 22 and flat coating 10 occurs most frequently at a relative center region 42 of each shroud segment 44 of the shroud 12. This leads to abradable material removal (particularly from, though not limited to the patterned layer 18) most prominently at the center region 42 of the shroud segments 44, where a radial distance from the rotor 23 is at a minimum relative to edges 46 of the shroud segments 44. This removal creates the circumferential curvature 41, such as that illustrated in FIG. 6. Thus, the rotating tip 22 may be used to intentionally shape the desired circumferential curvature 41 and axial concavity 30 in the coating 10. In addition, it should be appreciated that a rotating tip 22 (or moving component of any kind that operates in proximity to the shroud or substrate) may be chosen to include a desirable shape (concave, convex, or otherwise) that will move/rotate to shape an abradable coating, as desirable, via a removal of abradable material caused by the moving/rotating.

Furthermore, it should be appreciated that the layers 16 and 18, particularly the patterned layer 18, may be applied in such a manner that a sufficient portion (at least about 50% of an original ridge height 40 in an exemplary embodiment) of the layer 18 will remain following intentional shaping via the rotating tip 22. For example, as shown in an exemplary embodiment illustrated in FIGS. 2 and 3, the ridges 20 of the layer 18 may be created to include an original height 32 that is sized to prevent more than about 50% of any of the ridges 21 from being abraded by the rotating tip 22. Sizing the ridges 21 in this manner makes it likely that at least a portion of the abradable layers 16 and 18 will remain intact after shaping, and that some of this portion will continue to include any aerodynamic benefits of the at least partially remaining ridges 21. It should be appreciated however, that some regions of the layer 18 may have more than 50% of abradable material eroded away during shaping.

Figure 7:
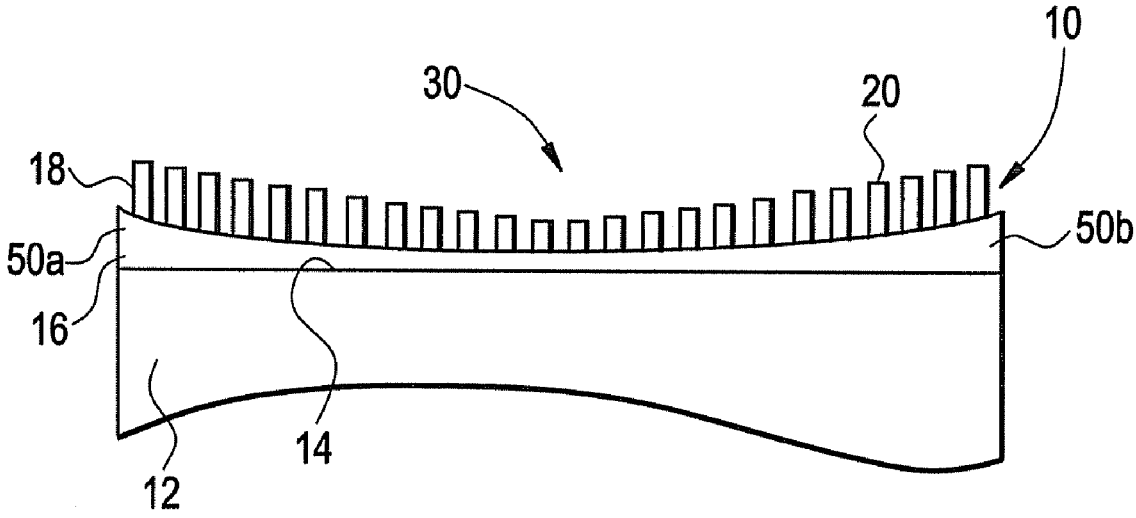
FIG. 7 is a schematic cross-section of a side view of the abradable coating applied to a substrate in accordance with an alternate embodiment, wherein the substrate includes a substantially flat surface and the coating has been shaped.
Figure 8:
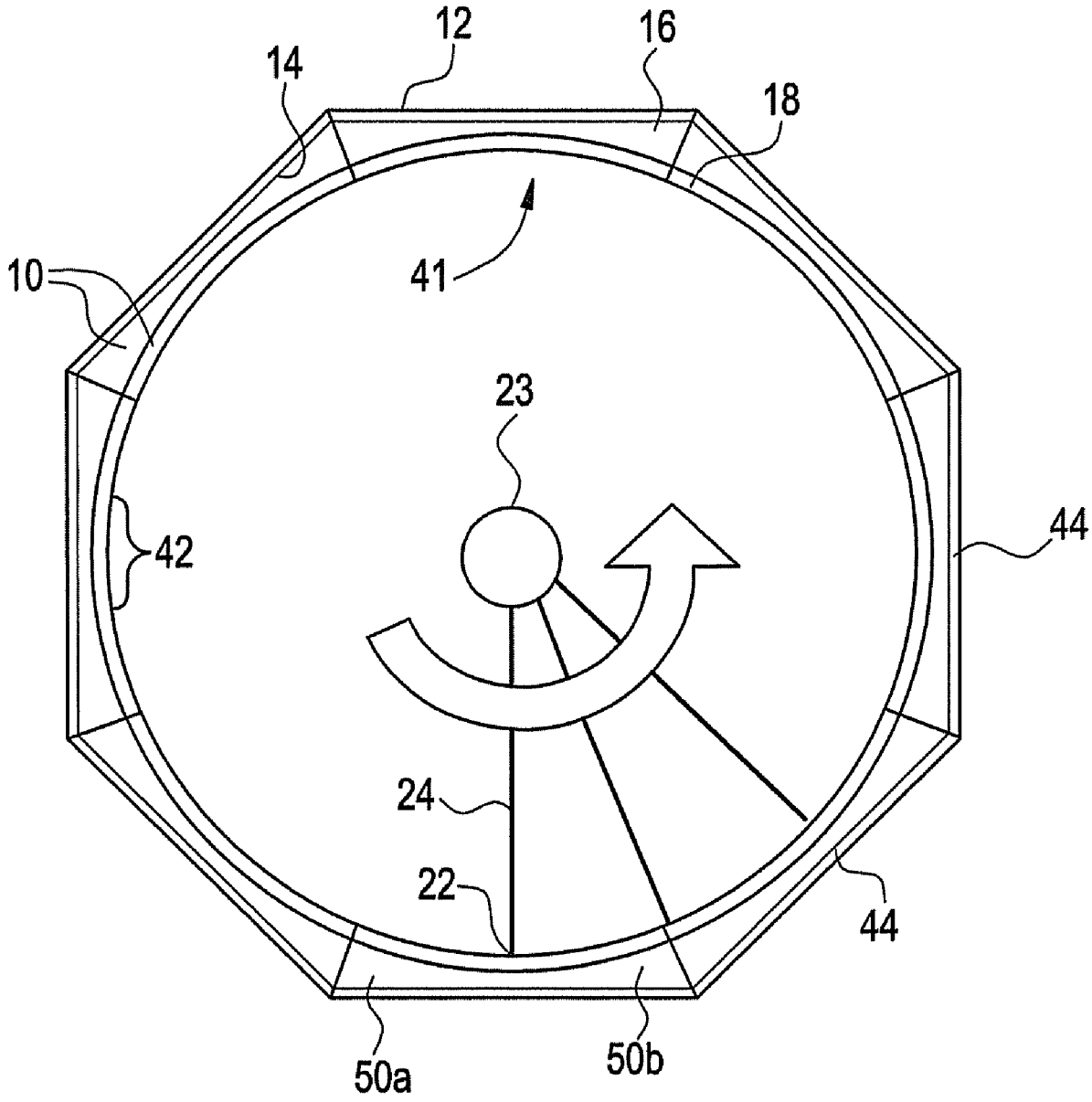
FIG. 8 is a schematic representation of a side view of the abradable coating applied to a substrate in accordance with an alternate embodiment, wherein the substrate includes a substantially flat surface and the coating has been shaped.

In addition, referring again to FIGS. 3 and 6, as well as 7 and 8, at least one of the layers 16 and 18 may also be either machined or applied in a selective manner to create a variable thickness (see relatively thicker regions 50*a* and 50*b*) in at least one of the layers 16 and 18, to create at least one of the desired axial concavity 30 or a circumferential curvature 41. For example, in FIGS. 3 and 6 the patterned layer 18 may have been applied to the adhering layer 18, with the patterned layer 18 (or both layers 16 and 18) either having been applied more thickly at the selected thicker regions 50*a* and 50*b*, or applied evenly and then machined at the areas of the centerline 26 (for axial concavity 30) and/or center region 42 (for circumferential curvature 41) to create the desired profile. Referring to FIGS. 7 and 8, the adhering layer 16 may also be first applied to the shroud surface(s) 14, either more thickly at the selected thicker regions 50*a* and 50*b*, or evenly across the surface 14, with the layer 16 then being machined at the areas of the centerline 26 (for axial concavity 30) and/or center region 42 (for circumferential curvature 41) to create the desired profile. Whether one or both of the layers 16 and 18 is applied more thickly at selected regions, applied evenly and machined in a desired fashion, or applied evenly and intentionally removed via the blade tip 22, the end result is a coating 10 that is applied to the flat surface 14, but includes a desired axial concavity 30 and/or circumferential curvature 41. Referring to the machining of the layers 16 and 18, it should be appreciated that machining can be accomplished via any desired process, such as but not limited to grinding (in an exemplary embodiment), cutting, ultrasonic machining, and laser ablating.

It should still further be appreciated that the coating 10 referred to throughout the disclosure may be any type of abradable coating (such as a continuous porous metallic coating) including and applied in any number of coating layers.

Figure 9:
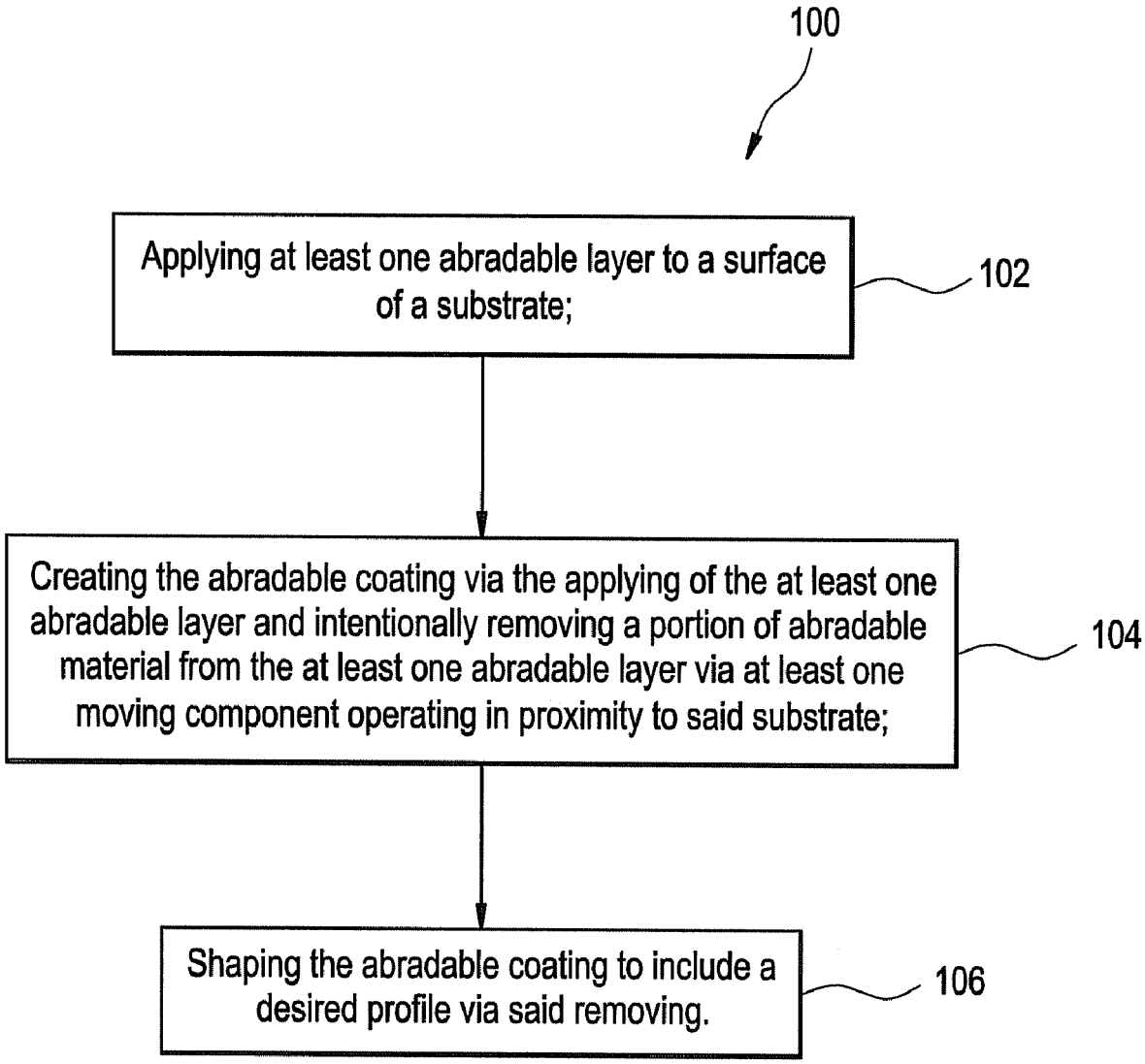
FIG. 9 is a block diagram illustrating a method for applying and dimensioning the abradable coating.

Referring to FIG. 9, a method 100 for applying and dimensioning an abradable coating is illustrated in a block diagram. The method 100 includes applying at least one abradable layer 16/18 to a surface of a substrate, as shown in operational block 102, wherein the substrate may be a turbine shroud 12 including a substantially flat surface 14. The method 100 also includes creating the abradable coating 10 via the applying of the at least one abradable layer 16/18 and intentionally removing a portion of abradable material from the at least one abradable layer 16/18 via at least one moving component, such as a tip 22 of a rotating bucket 24, operating in proximity to said substrate, as shown in operational block 104. The method 100 further includes shaping the abradable coating 10 to include a desired profile, such as an axial concavity 30 and/or circumferential curvature 41, via said removing, as shown in operational block 106.

Figure 10:
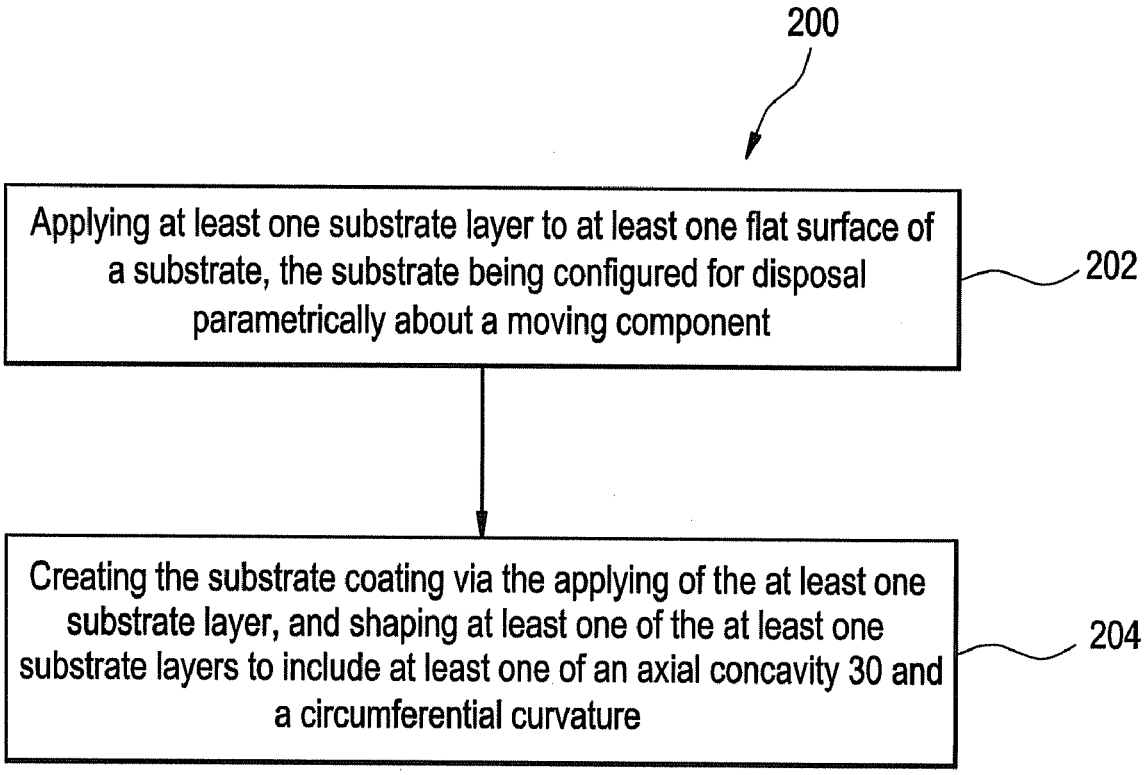
FIG. 10 is a block diagram illustrating a method for applying and dimensioning the abradable coating.

Referring to FIG. 10, a method 200 for applying and dimensioning a substrate coating 10 is illustrated and includes applying at least one substrate layer 16/18 to at least one flat surface 14 of a substrate 12, the substrate 12 being configured for disposal parametrically about a moving component 24, as shown in operational block 202. The method 200 also includes creating the substrate coating 10 via the applying of the at least one substrate layer 16/18, and shaping at least one of the at least one substrate layers 16/18 to include at least one of an axial concavity 30 and a circumferential curvature 41, as shown in operational block 204.

While the invention has been described with reference to an exemplary embodiment, it should be understood by those skilled in the art that various changes may be made and equivalents may be substituted for elements thereof without departing from the scope of the invention. In addition, many modifications may be made to adapt a particular situation or substance to the teachings of the invention without departing from the scope thereof. Therefore, it is important that the invention not be limited to the particular embodiment disclosed as the best mode contemplated for carrying out this invention, but that the invention will include all embodiments falling within the scope of the apportioned claims. Moreover, unless specifically stated any use of the terms first, second, etc. do not denote any order or importance, but rather the terms first, second, etc. are used to distinguish one element from another.

What is claimed is:

1. A method for forming a substrate coating, the method comprising:

forming a shroud to perimetrically surround a moving component, which is rotatable about a longitudinal axis of the shroud;

applying a substrate layer to an interior surface of the shroud to form the substrate coating with a plurality of substantially flat interior facing surfaces each meeting an adjacent surface to form an obliquely angled edge; and rotating the moving component within the shroud to selectively remove a portion of the substrate coating via contact between the substrate layer at each of the interior facing surfaces and the moving component to thereby shape each of the interior facing surfaces to respectively include:

an axial profile having an axial concavity complementary to a radial curvature of an axial shape of a tip of the moving component and a circumferential curvature complementary to a pattern traced by the tip of the moving component.

2. The method according to claim 1, wherein the substrate layer comprises an abradable coating.

3. The method according to claim 1, wherein the substrate layer comprises an adhering layer and a patterned layer.

4. The method according to claim 1, wherein the applying of the substrate layer comprises applying an adhering layer to the interior surface of the shroud.

5. The method according to claim 1, wherein the applying of the substrate layer comprises creating at least one ridge in the substrate layer.

6. The method according to claim 5, wherein the creating of the at least one ridge comprises creating the at least one ridge with an original height that will remain at least about 50 percent following the selective removal of the portion of the substrate.

7. The method according to claim 5, wherein the creating comprises machining of the substrate layer.

8. The method according to claim 1, wherein the applying of the substrate layer comprises allowing for the axial concavity and the circumferential curvature.

9. The method according to claim 1, wherein the moving component comprises a rotating turbine bucket.

* * * * *